US008096716B2

(12) United States Patent
Kobayashi et al.

(10) Patent No.: US 8,096,716 B2
(45) Date of Patent: Jan. 17, 2012

(54) TAPE PRINTING APPARATUS

(75) Inventors: Shinji Kobayashi, Tokai (JP); Akira Sago, Seto (JP); Takehiko Inaba, Obu (JP); Keiji Seo, Nagoya (JP); Atsushi Kasugai, Nagoya (JP)

(73) Assignee: Brother Kogyo Kabushiki Kaisha, Nagoya-Shi, Aichi-Ken ( * ) Notice: Subject to any disclaimer, the term of this patent is extended or adjusted under 35 U.S.C. 154(b) by 820 days.

(21) Appl. No.: 12/214,710

(22) Filed: Jun. 20, 2008

(65) Prior Publication Data

US 2009/0028624 A1 Jan. 29, 2009

(30) Foreign Application Priority Data

Jul. 26, 2007 (JP) ..... 2007-194112

(51) Int. Cl.
*B41J 15/00* (2006.01)

(52) U.S. Cl. ..... 400/615; 400/615.1; 400/59; 400/266

(58) Field of Classification Search ..... 400/88, 400/611, 613, 691, 692, 615, 59, 286.3, 357, 400/366, 615.1
See application file for complete search history.

(56) References Cited

U.S. PATENT DOCUMENTS

| | | | | |
|---|---|---|---|---|
| 3,778,842 | A * | 12/1973 | Saito | 346/136 |
| 6,118,469 | A * | 9/2000 | Hosomi | 347/222 |
| 6,345,782 | B1 * | 2/2002 | Nakayama et al. | 242/564.4 |

FOREIGN PATENT DOCUMENTS

| | | |
|---|---|---|
| JP | 01-169348 U | 11/1989 |
| JP | 2050868 | 2/1990 |
| JP | 03-079960 U | 8/1991 |
| JP | 5-449346 U | 6/1993 |
| JP | 2005212139 | 8/2005 |

* cited by examiner

*Primary Examiner* — Matthew G Marini
(74) *Attorney, Agent, or Firm* — Day Pitney LLP

(57) ABSTRACT

If a top cover 5 has been opened, a link lever 34 is moved backward in conjunction with the motion of the top cover 5, so that a release lever 51 is rotated clockwise as seen from the left side about a level shaft 50. Also, a release gear 49 and a release shaft 48 are rotated about 180° counterclockwise as seen from the left side, via a lever gear 52. Accordingly, a head supporting member 37 is rotated downward, resisting an urging force of a pressing spring 36, so that a thermal head 32 is separated from a platen roller 35 and entry of a roll sheet 3A becomes possible through an insertion port 26.

6 Claims, 14 Drawing Sheets

TAPE PRINTING APPARATUS

CROSS-REFERENCE TO RELATED APPLICATIONS

The present application claims priority from Japanese Patent Application No. 2007-194112, filed on Jul. 26, 2007, the disclosure of which is herein incorporated by reference in its entirety.

TECHNICAL FIELD

The disclosure relates to a tape printing apparatus which accommodates a roll sheet holder wound with a long roll sheet detachably in a main body case.

BACKGROUND

Conventionally, various types of tape printing apparatuses have been proposed which accommodate a roll sheet holder wound with a long roll sheet detachably in a main body case. For example, a lever for moving a thermal head up and down is provided at a front end portion in a carrying direction of a side end portion of a roll sheet holder-accommodating portion, and by means of the rotation of this lever in an upward direction, the thermal head is moved downward and then separated from the platen roller. Further, a tape printing apparatus exists in which by means of the downward rotation of a lever, the thermal head is moved upward so that the roll sheet is pressed against the platen roller so as to enable the roll sheet to be printed (for example, Japanese Unexamined Patent Publication No. 2005-212139).

However, the tape printing apparatus described in the above Japanese Unexamined Patent Publication No. 2005-212139 leads to a problem that the lever operation becomes complicated because each time that the roll sheet is loaded, the lever needs to be rotated upward so as to lower the thermal head and after the roll sheet is inserted, that lever again needs to be rotated downward.

SUMMARY

The disclosure has been made in view of the above circumstances and has an object to overcome the above problem and to provide a tape printing apparatus on which loading of the roll sheet can only be achieved by the opening and closing of a top cover which covers the top portion of the roll sheet holder.

To achieve the object, there is provided a tape printing apparatus including an accommodating portion which accommodates a roll sheet holder wound with a long roll sheet detachably in a main body case, a carrying unit for carrying the roll sheet, and a top cover that is mounted on a top end portion on a rear side of the main body case so as to be capable of being opened and closed freely and to cover a top side of the roll sheet holder, wherein, the carrying unit includes a carrying roller that comes into contact with the roll sheet so as to carry the roll sheet in a sheet carrying direction, and a pressing unit which presses the roll sheet against an outer peripheral face of the carrying roller, the tape printing apparatus further comprising: a link lever, an end portion of one side of which is mounted onto the top cover rotatably and detachably; and a release unit which achieves contact by pressure between the carrying roller and the pressing unit, and their separation from each other, in conjunction with opening and closing of the top cover by means of the link lever.

In the tape printing apparatus, in conjunction with the opening and closing of the top cover, contact by pressure between the carrying roller and the pressing unit and separation from each other are achieved by means of the link lever, an end of which is mounted rotatably and detachably on the top cover. Consequently, the roll sheet can be loaded only by means of the opening and closing of the top cover which covers the top side of the roll sheet holder to thereby make loading of the roll sheet simple. Additionally, by forming the link lever in a flat shape, a reduction in the size of the tape printing apparatus can be achieved.

DETAILED DESCRIPTION

Figure 1:
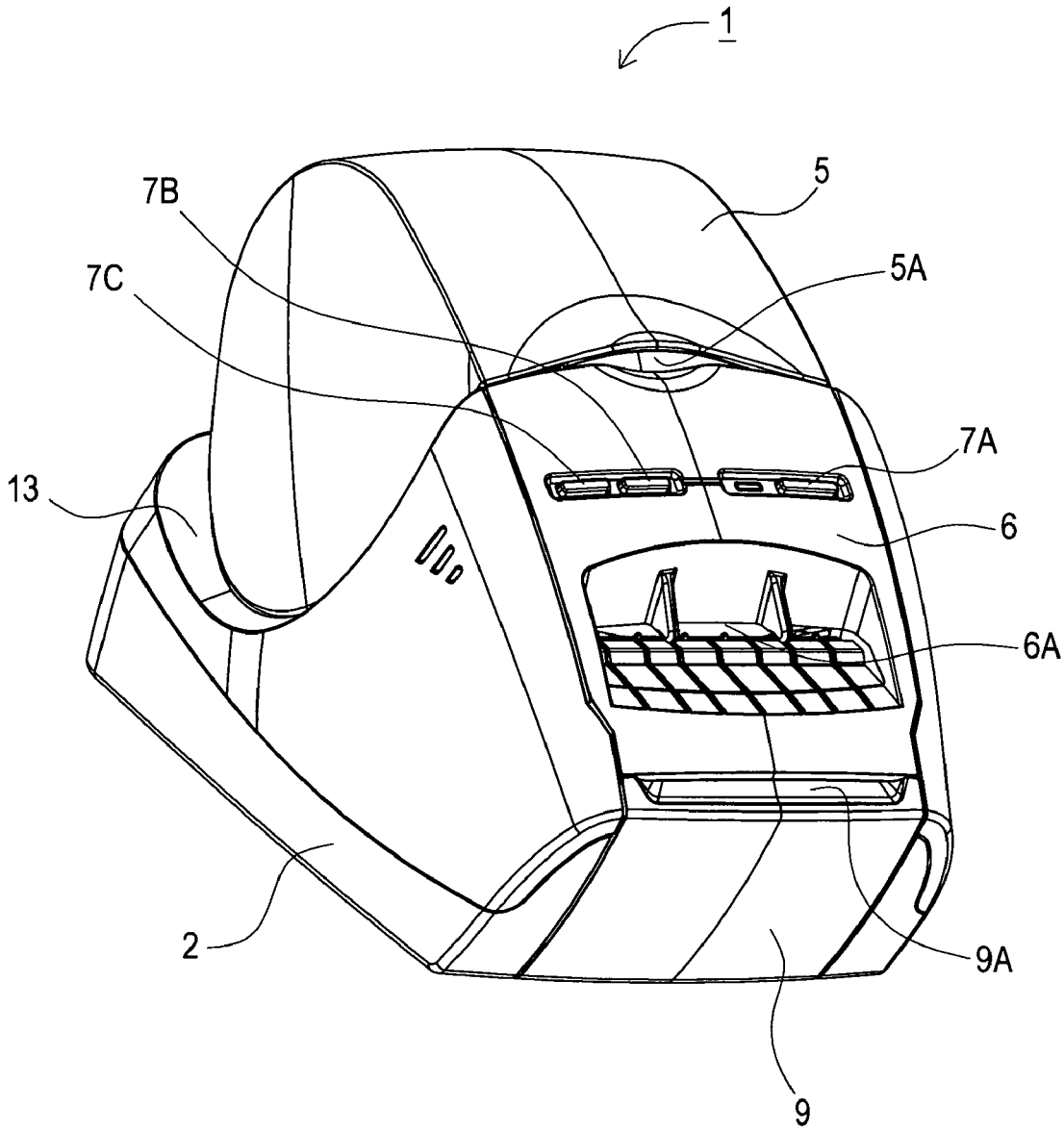
FIG. 1 is an appearance perspective view of a tape printing apparatus of the embodiment as seen from its front side.

Hereinafter, an exemplary embodiment of a printing apparatus of the disclosure will be described in detail with reference to the drawings.

Embodiment

First, the schematic structure of the printing apparatus loaded with a roll sheet holder according to the embodiment will be described based on FIGS. 1 to 6.

As shown in FIG. 1-FIG. 6, the tape printing apparatus 1 includes a main body case 2 made of resin and a top cover made of transparent resin mounted on the top edge portion on the rear side such that it can be opened and closed freely to cover the top side of the roll sheet holder-accommodating portion 4 which accommodates the roll sheet holder 3 wound with a roll sheet 3A having a predetermined width. This roll sheet 3A is composed of a long heat sensitive sheet having a self-color development property (so-called thermal paper) or a long label sheet in which a separable paper has been bonded on a single face of the heat sensitive sheet by means of an adhesive agent, and which long label sheet is wound around a roll sheet holder 3.

A sheet discharge port 6A for discharging a printed roll sheet 3A is formed on a front cover 6 on the front side of the top cover 5. A power button 7A; a cut button 7B which, when it is pressed down, drives a cutter unit 8 (see FIG. 5) that is provided inside the sheet discharge port 6A and cuts a roll sheet 3A; and a feed button 7C which, when it is pressed, discharges the roll sheet 3A in the carrying direction, are all arranged substantially horizontally on a front face portion above the sheet discharge port 6A.

Figure 5:
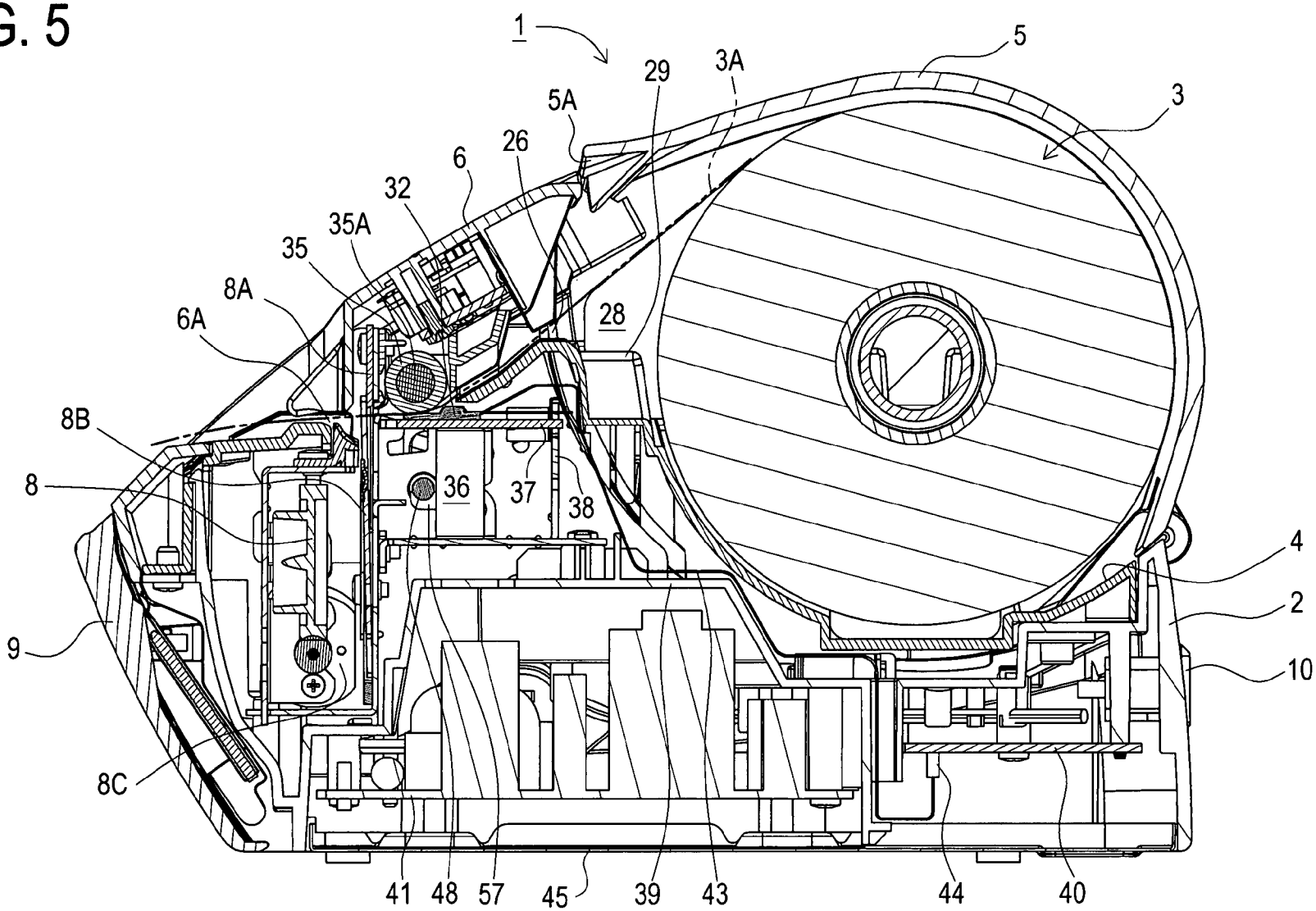
FIG. 5 is a side sectional view of a state in which the roll sheet holder has been loaded on the tape printing apparatus.

As shown in FIG. 5, the cutter unit 8 is constituted of a fixed blade 8A and a movable blade 8B, and when the cut button 7B is pressed down, the movable blade 8B is reciprocated vertically by a cutting motor 8C constituted of a DC motor or the like. A roll sheet 3A that has been cut by the fixed blade 8A and the movable blade 8B is discharged through the sheet discharge port 6A. The movable blade 8B is formed in a V shape, as seen from the front side.

A tray member 9 is attached to the bottom edge portion of the front cover 6 such that it can be opened and closed freely so as to cover the front side of the front cover 6, and the tray member 9 can be opened by hooking the finger on a concave portion 9A formed on the top end portion so as to rotate the front cover 6 forward.

Figure 3:
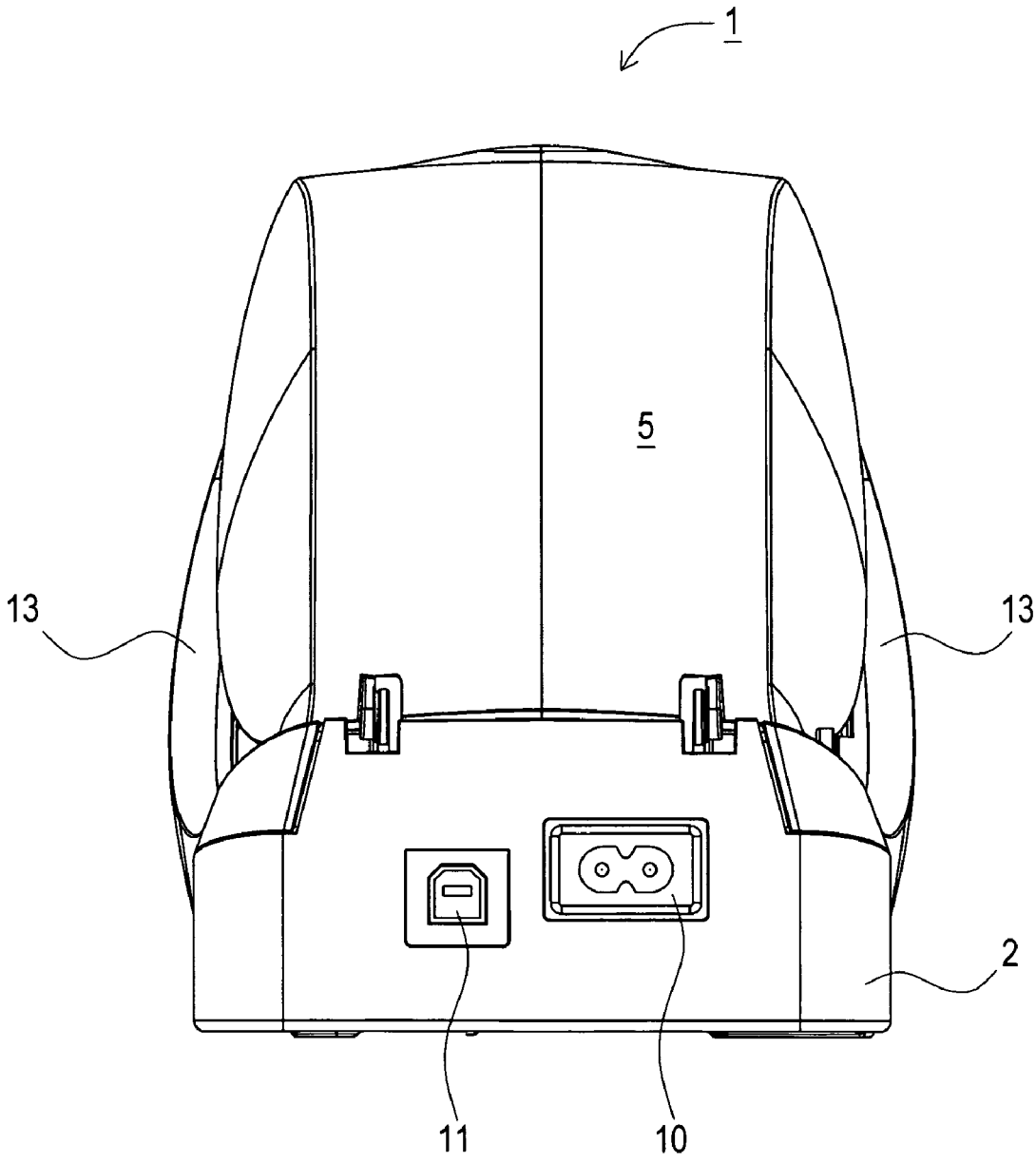
FIG. 3 is a rear view of the tape printing apparatus.

Further, an inlet 10, to which a power cord (not shown) can be connected, is disposed on the rear face portion of the main body case 2, and a USB (universal serial bus) connector 11, which is to be connected to a personal computer or the like (not shown), is provided on a side thereof (left side in FIG. 3).

Figure 2:
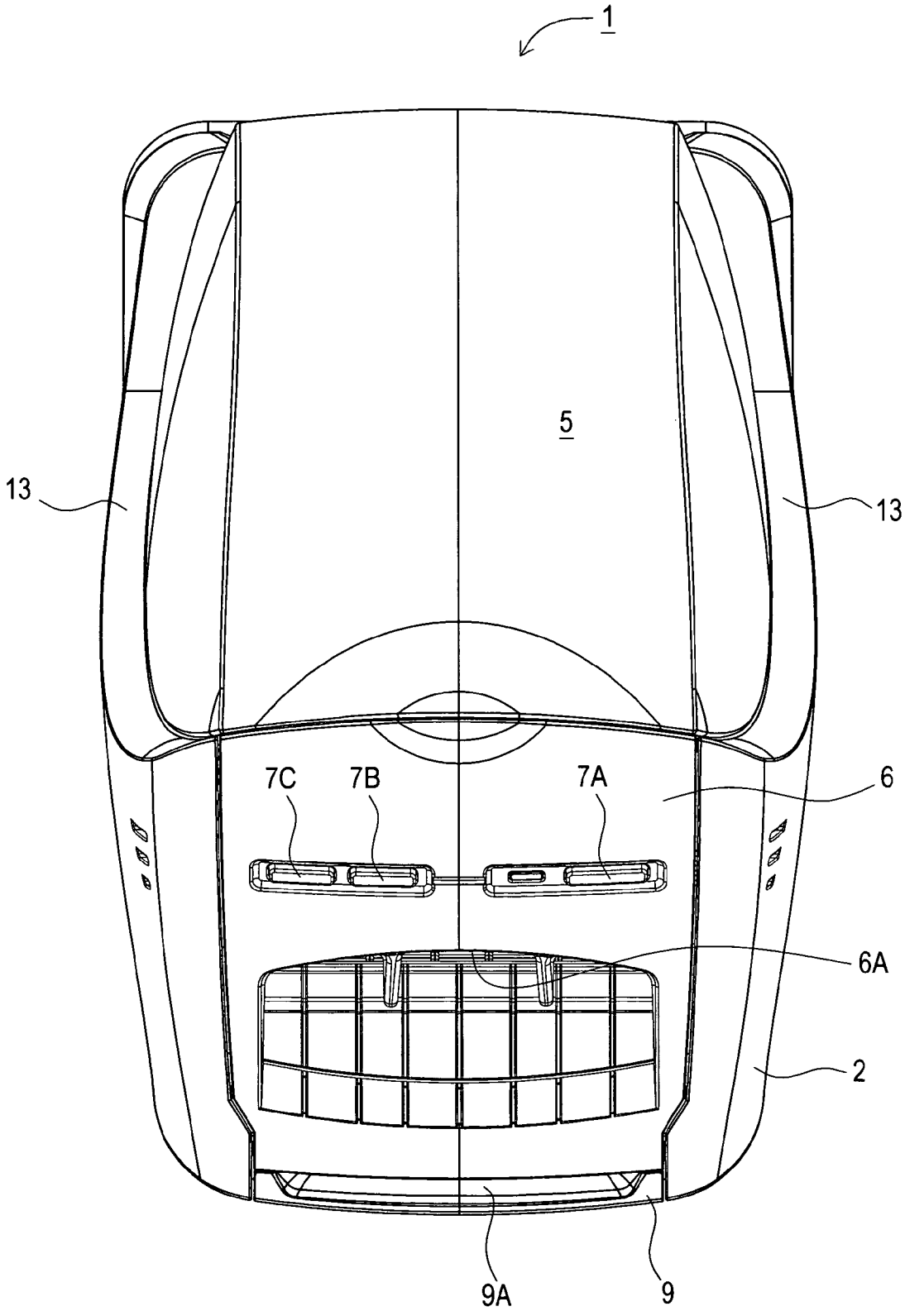
FIG. 2 is a plan view of the tape printing apparatus.

As shown in FIG. 2 and FIG. 3, the top cover 5 is formed into a substantially semi-circular configuration in its side view, and the opening portion of the top cover 5 is formed such that it becomes narrower as it approaches a mounting portion attached to the top edge portion on the rear side of the main body case 2. The right and left side edge portions of the main body case 2, with which the opening portion of the top cover 5 comes into contact, are formed into step portions 13, 13 which are extended outward by a predetermined width (for example, about 10 mm).

Figure 4:
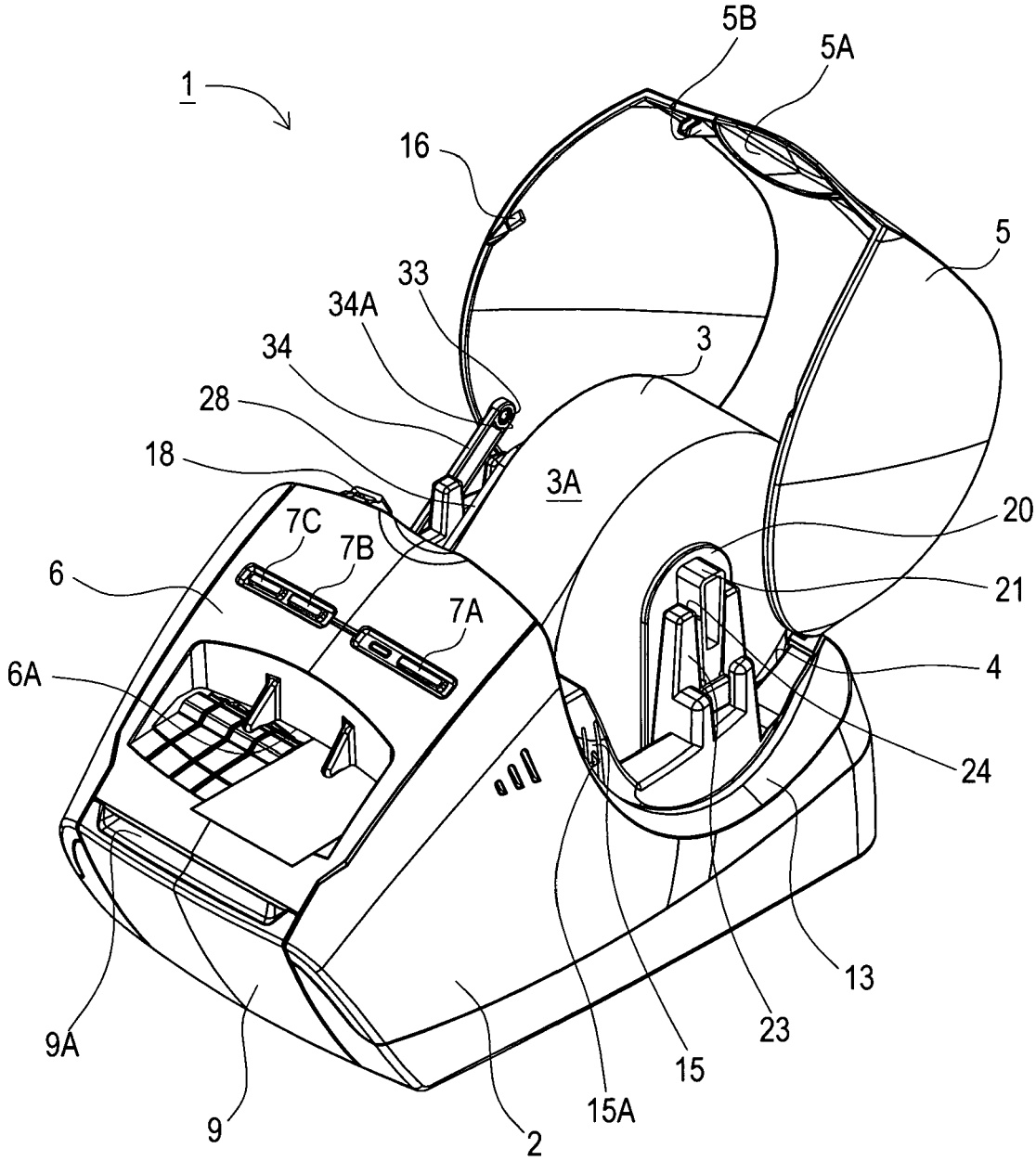
FIG. 4 is a perspective view of the tape printing apparatus showing a state in which a roll sheet holder has been loaded thereon with its top cover opened, as seen from the upper right hand side.
Figure 6:
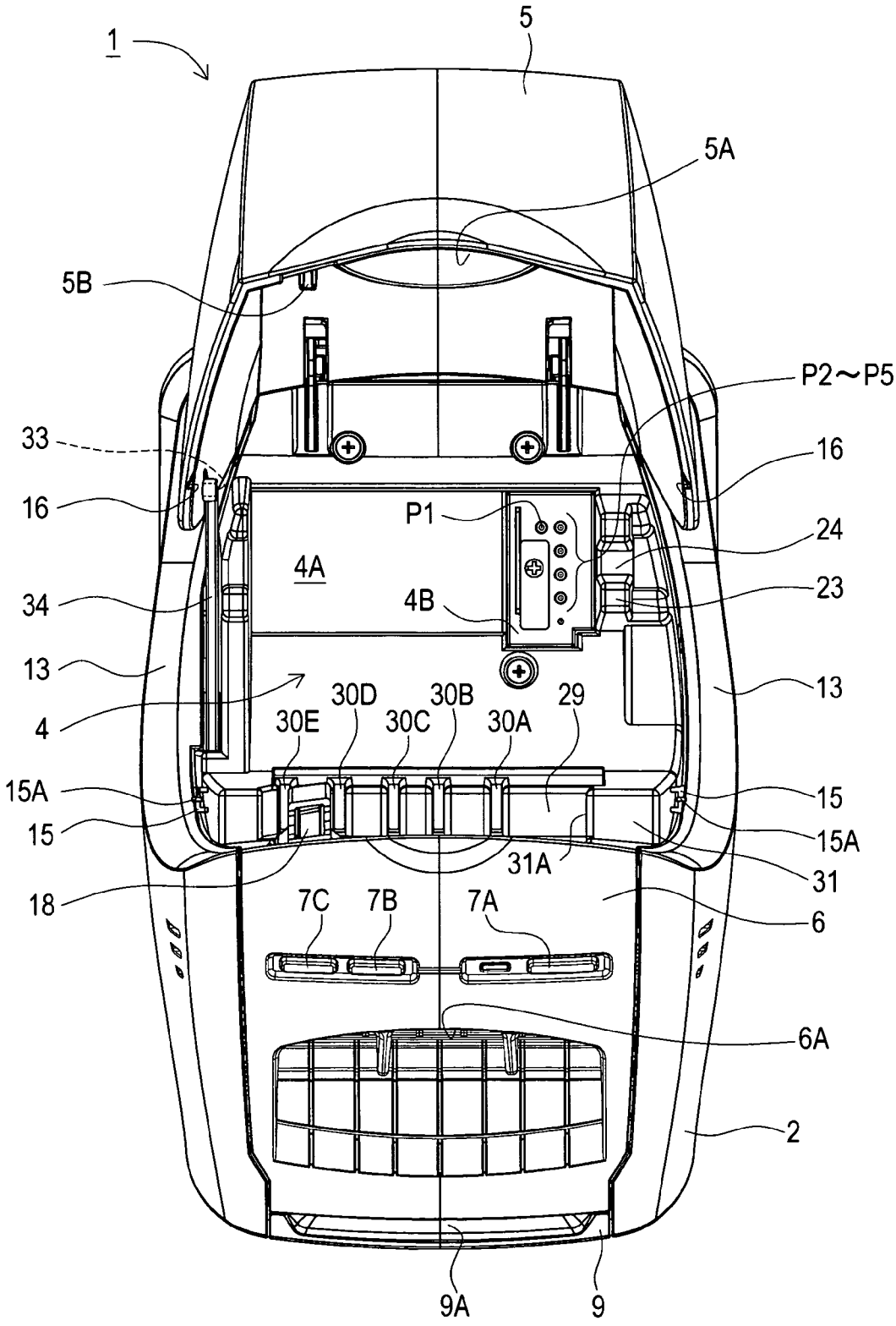
FIG. 6 is a plan view of the tape printing apparatus with the top cover opened.
Figure 8:
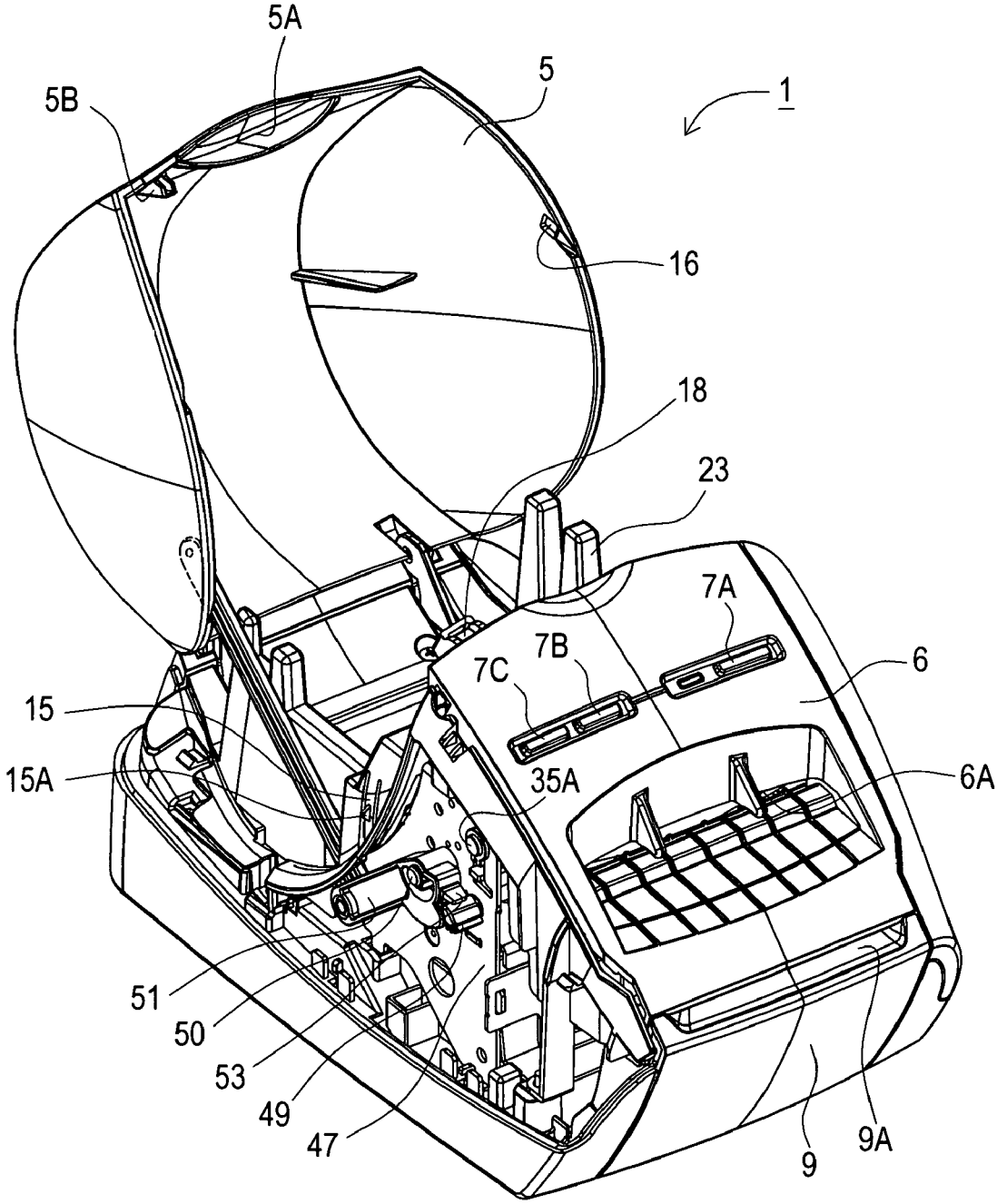
FIG. 8 is a perspective view of a state in which the top cover of the tape printing apparatus has been opened, as seen from the upper left side after the side wall portion on the left side of the main body case has been removed.

As shown in FIG. 4 and FIG. 6, right and left side wall portions on the front side of the roll sheet accommodating portion 4 are provided with elastic locking pieces 15, 15 formed such that they are elastically deformable inward. The elastic locking pieces 15, 15 respectively have a locking projection 15A having a triangular section in its side view which projects outward and which can be respectively engaged with locking concave portions 16, 16 formed on the side edge portions of the opening portion of the top cover 5 (FIG. 4 represents one locking concave portion 16 and FIG. 8 represents the other locking concave portion 16).

Consequently, when the top cover 5 is rotated forward and brought into contact with each of the step portions 13, the elastic locking pieces 15 engage the locking concave portions 16 so that the top cover 5 is held in a closed state. By means of the finger being hooked on a concave portion 5A formed at the center of the front end of the top cover 5, and by means of the backward rotation of the top cover 5, engagement between the elastic locking pieces 15 and the locking concave portions 16 are terminated so that the top cover 5 can be opened.

A pushing projection portion 5B is provided on the left side of the front face of the concave portion 5A of the top cover 5 such that it projects by a predetermined length in a forward direction. Further, a top cover detection switch 18, which is constituted of a micro switch or the like and which determines whether or not it has been pushed by the pushing projection portion 5B, in other words whether or not the top cover 5 has been closed, is disposed at a position with which the pushing projection portion 5B of the main body case 2 comes into contact whenever the top cover 5 is closed.

As shown in FIG. 4 and FIG. 6, the tape printing apparatus 1 has a holder-supporting member 23 that is projected outward of a positioning and holding member 20 which constitutes the roll sheet holder 3 and to which positioning and holding member 20 a mounting member 21 having a substantially rectangular section can be fitted on a side end portion on one side (the right side end in FIG. 4) that is substantially perpendicular to the carrying direction of the roll sheet holder-accommodating portion 4. This holder-supporting member 23 has a first positioning groove portion 24 having a substantially elongated U shape in its side view and which is open on both sides in the width direction as well as in an upward direction.

A loading portion 29 (see FIG. 12) is provided such that it is extended substantially horizontally from the edge portion of the rear end of an insertion port 26 (see FIG. 5) in which the roll sheet 3A can be inserted up to the edge portion at the top end on the front side of the roll sheet holder-accommodating portion 4. Further, five second positioning groove portions 30A-30E, each having a substantially L shaped section, are formed on the corner portions of the edge on the rear end in the carrying direction of this loading portion 29, corresponding to plural width dimensions of the roll sheet 3A. The second positioning groove portions 30A-30E are formed so that the bottom end portion of the front end, which comes into contact with the loading portion 29 of the guide member 28 constituting the roll sheet holder 3, can be fitted thereto, as shown in FIG. 5.

A positioning concave portion 4A rectangular in its plan view is formed on the bottom portion of the roll sheet holder-accommodating portion 4 such that it is extended substantially perpendicularly from the proximal end portion on the inside of the holder-supporting member 23 up to the proximal end portion of an opposing side face to a predetermined depth (about 1.5-3 mm in this embodiment). The width in the carrying direction of the positioning concave portion 4A is defined to be a dimension that is substantially identical to the widths of each bottom end portion of the positioning and holding member 20 and of the guide member 28 which together constitute the roll sheet holder 3.

A determining concave portion 4B rectangular in its plan view with a longer side in the carrying direction is formed on the proximal end portion inside of the holder-supporting member 23 of the positioning concave portion 4A, to a predetermined depth (about 1.5-3 mm in this embodiment) that is greater than that of the positioning concave portion 4A, a determining concave portion 4B opposing the sheet determining portion (not shown) which is extended substantially at right angles inward from the bottom end portion of the positioning and holding member 20.

Five sheet determining sensors P1, P2, P3, P4, P5 for determining factors such as the type, material and width of the roll sheet 3A are provided on this determining concave portion 4B, each of the sheet determining sensors being constituted of a push-type micro switch or the like.

The sheet determining sensors P1-P5 are constituted of a known mechanical switch containing a plunger and a micro switch, and the top end portion of the plunger is projected from the bottom face of the determining concave portion 4B up to the vicinity of the bottom portion of the positioning concave portion 4A. Further, the sheet determining sensors P1-P5 detect whether or not a sensor hole (not shown) exists, the sensor holes being formed in the sheet determining portion extended substantially at right angles inward from the bottom end portion of the positioning and holding member 20 to the sheet determining sensors P1-P5, in order to detect, by means of ON/OFF signals, factors such as the type, material and width of a roll sheet 3A that is wound on the roll sheet holder 3.

Furthermore, according to this embodiment, the respective sheet determining sensors P1-P5 are so constructed that the plungers are constantly projected from the bottom face of the determining concave portion 4B up to the vicinity of the bottom face portion of the positioning concave portion 4A, so that the micro switches are in an OFF state. Whenever each sensor hole in the sheet determining portion is located at a position opposing the sheet determining sensors P1-P5, the plunger is not pressed down the micro switch is in an OFF state and for an OFF signal is accordingly output.

On the other hand, if the sensor hole in the sheet determining portion is not located at any position opposing the sheet determining sensors P1-P5, the plunger is pressed so that the micro switch is turned ON, and an ON signal is accordingly output. Thus, the respective sheet determining sensors P1-P5 output 5-bit "0" and "1" signals, and, if all the sheet determining sensors P1-P5 are in an OFF state, in other words, if no roll sheet holder 3 has been loaded, a 5-bit "00000" signal is output.

A guide portion 31 is formed on the edge portion on the side of the-holder-supporting member 23 of the insertion port 26 up to the rear end portion in the carrying direction of the loading portion 29 so as to guide the roll sheet 3A up to the insertion port 26. Here, the inner end face (left end face in FIG. 6) of this guide portion 31 is formed at a position opposing the inner end face of the positioning member 20 so as to be fitted to the holder-supporting member 23, that is, on an identical plane. Consequently, the edge of the outer side end of a roll sheet 3A that has been extracted from the roll sheet holder 3 comes into contact with the inner end face of this guide portion 31 so that it is introduced into the insertion port 26.

An engaging shaft 33 is provided projectingly from the inside of an opening portion periphery of the top cover 5 on the edge portion of a side end opposite to the holder-supporting member 23 of the holder-accommodating portion 4 such that it is formed at substantially the same height as the thickness of the link lever 34 that has circular section. Moreover, this engaging shaft 33 is fitted to a through hole 34A that has been formed in the end portion on one side of the link lever 34 which moves the thermal head 32 (see FIG. 5) vertically. The end portion of the link lever 34 is thus attached rotatably and detachably (see FIG. 9).

In other words, by distorting inward (rightward in FIG. 6) the end portion on the through hole 34A side of the link lever 34 more than the thickness of the link lever 34, the link lever 34 can be removed from the engaging shaft 33. Further, by expanding the opening portion of the top cover 5 outward, the link lever 34 can be removed from the engaging shaft 33. If the link lever 34 is removed from the engaging shaft 33, it can be reinstalled onto the top cover 5 by fitting the engaging shaft 33 to the through hole 34A in the link lever 34. Moreover, by the opening and closing this top cover 5, the link lever 34 is moved in a back and forth direction so as to move the thermal head 32 vertically as will be described later (see FIG. 10 and FIG. 11).

Further, a platen roller 35 is supported rotatably on a deep side in the roll sheet carrying direction of the insertion port 26, as shown in FIG. 5. The thermal head 32 is fixed to the top face of the head-supporting member 37 that is urged upward by a pressing spring 36. The end portion on the rear side in the carrying direction of the head-supporting member 37 is supported by the rear face portion such that it can swing vertically.

When the top cover 5 is closed, as will be described later, the thermal head 32 is urged upward by the pressing spring 36 and presses a roller sheet 3A against the platen roller 35 so that the roll sheet can be printed (see FIG. 10). When the top cover 5 is opened, the thermal head 32 moves away from the platen roller 35, as will be described later, so that the roll sheet 3A can be inserted through the insertion port 26 and move inwards between the platen roller 35 and the thermal head 32.

A control board 40 which has a control circuit portion formed thereon for controlling various mechanical portions such as the thermal head 32 in accordance with instructions from an outside personal computer or the like is arranged below the roll sheet holder-accommodating portion 4 that is separated by means of a partition wall 39. The control board 40 is provided such that the respective sheet determining sensors P1-P5 are connected electrically. A power supply board 41, in which a power supply circuit portion is formed, is provided below the frame 38 that is separated by the partition wall 39.

The thermal head 32 is connected to a connector 44 provided on the bottom face of the control board 40 with a flexible flat cable (FFC). The control board 40 and the power supply board 41 are covered with a bottom face cover 45 that is made of thin steel plate (steel plate such as SPCC of about 0.5 mm in thickness in this embodiment) screwed onto the bottom face portion.

Next, a mechanism for moving a thermal head 32 vertically in conjunction with the opening and closing of the top cover 5 will be described with reference to FIG. 5, FIG. 7-FIG. 11.

As shown in FIG. 5 and in FIG. 7-FIG. 9, the left side end portion of a release shaft 48 (see FIG. 10, FIG. 11) for moving the thermal head 32 vertically, as will be described later, is supported rotatably on a left side frame 47 which supports rotatably the left side end portion of the roller shaft 35A of the platen roller 35. The left side end portion of the release shaft 48 is also projected outward by a predetermined length (about 5 mm in this embodiment). A release gear 49 having a gear formed on about a half circumference of its outer periphery is attached to the left end portion of the release shaft 48.

A lever shaft 50 is erected behind the release gear 49 on the left side frame 47 and is fitted rotatably to a through hole 51A that has been bored at an end of the release lever 51 in a thickness direction. A lever gear 52, which meshes with the release gear 49, is formed on an approximately half portion of the outer periphery on the release lever 51 side of the through hole 51A that opposes the release gear 49 when the top cover 5 has been closed.

Further, a contact piece 53 that is capable of making contact with the flat portion of the release gear 49, in which no gear is formed, is provided projectingly at a portion of the upper portion of the lever gear 52 of the release lever 51. Consequently, when the release lever 51 is rotated backward so that the lever gear 52 is about to disengage from the release gear 49, the contact piece 53 comes into contact with the release gear 49, thereby limiting rotation of the release lever 51. The other end portion (bottom end portion in FIG. 7) of the release lever 51 is connected rotatably to the end portion of the link lever 34 that has been inserted through an insertion hole 55 having a substantially rectangular section with a longer vertical side formed in the edge portion of the step portion 13.

Figure 7:
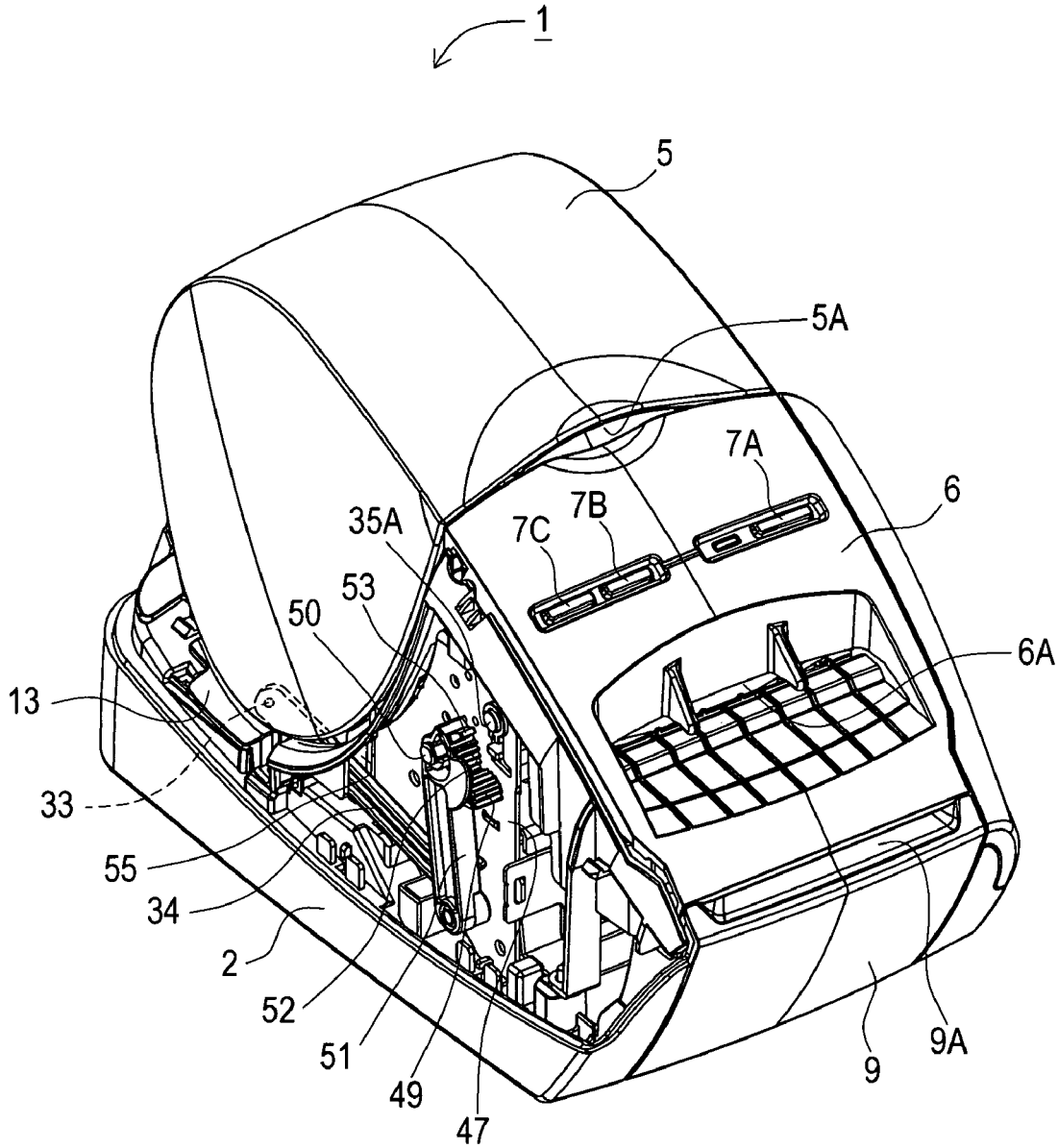
FIG. 7 is a perspective view of a state in which the top cover of the tape printing apparatus has been closed, as seen from the upper left side after the side wall portion on the left side of the main body case has been removed.

Accordingly, when the top cover 5 has been closed, as shown in FIG. 7, the link lever 34 is moved forward in conjunction with the motion of the top cover 5. The release lever 51 is thus rotated counterclockwise, as seen from the left side, about the lever shaft 50, the release gear 49 thereby being rotated about 180° by means of the lever gear 52.

Figure 10:
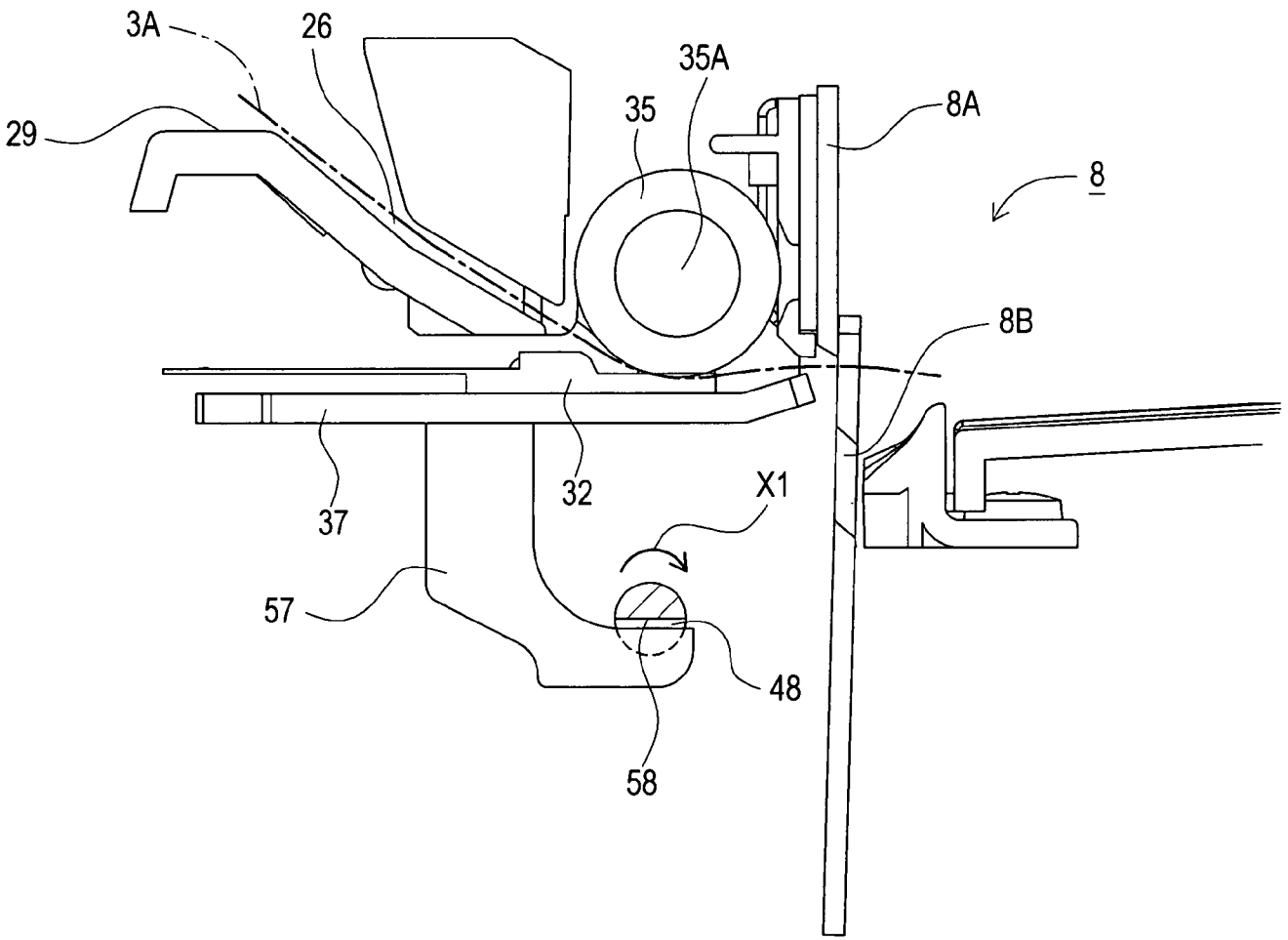
FIG. 10 is a left side view of enlarged major portions showing a state in which a thermal head is pressed against a platen roller.

As a result, if the release gear 49 is rotated about 180° counterclockwise, as seen from the left side and as shown in FIG. 10, the release shaft 48, the left edge portion of which is mounted onto the release gear 49, is rotated about 180° clockwise (direction of the arrow X1 in FIG. 10) as seen from the left side. Moreover, the tip of a bottom interference member 57, which has a substantially L shaped side view, and which is provided on the bottom face of the thermal head supporting member 37, is located below a cutout face 58 of the release shaft 48. Consequently, the tip of the bottom interference member 57 is not pressed down by the release shaft 48. Accordingly, the head supporting member 37 is rotated upward by the pressing spring 36, and the thermal head 32 thus presses the roll sheet 3A against the platen roller 35 and enables the roll sheet 3A to be printed.

Figure 9:
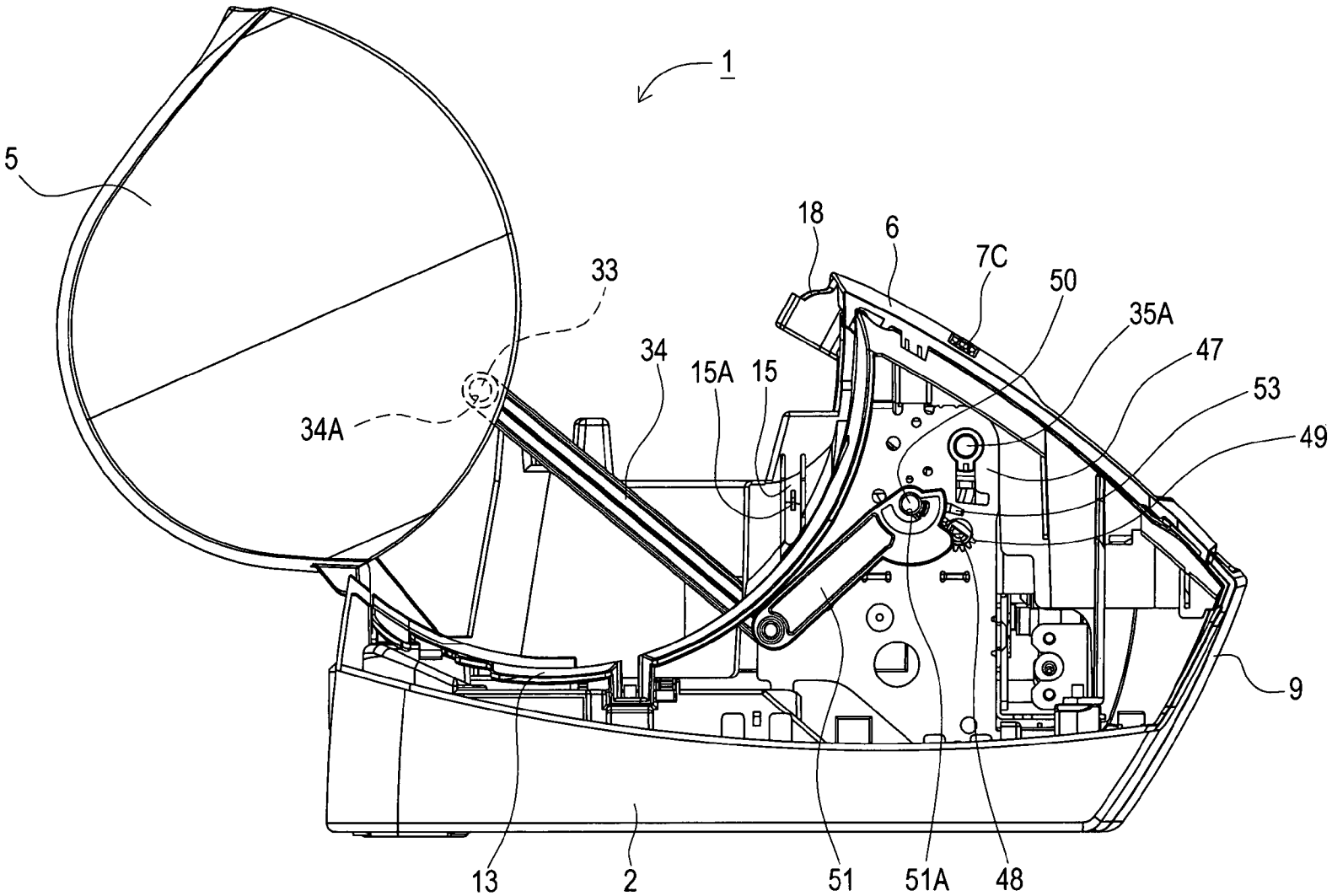
FIG. 9 is a left side view of a state in which the top cover of the tape printing apparatus has been opened after the side wall portion on the left side of the main body case has been removed.

If the top cover 5 has been opened, as shown in FIG. 8 and FIG. 9, the link lever 34 is moved backward in conjunction with the motion of the top cover 5, so that the release lever 51 is rotated clockwise as seen from the left side about the lever shaft 50. In conjunction with a rotation of the release lever 51, the release gear 49 is rotated about 180° counterclockwise, as seen from the left side, via the lever gear 52. Further, the bottom end portion of the release lever 51 comes into contact with the outer periphery of the insertion hole 55 thereby limiting the opening angle of the top cover 5. As shown in FIG. 9, a predetermined gap is formed between the contact piece 53, which is provided projectingly on the upper side of the lever gear 52 of the release lever 51, and the release gear 49.

Figure 11:
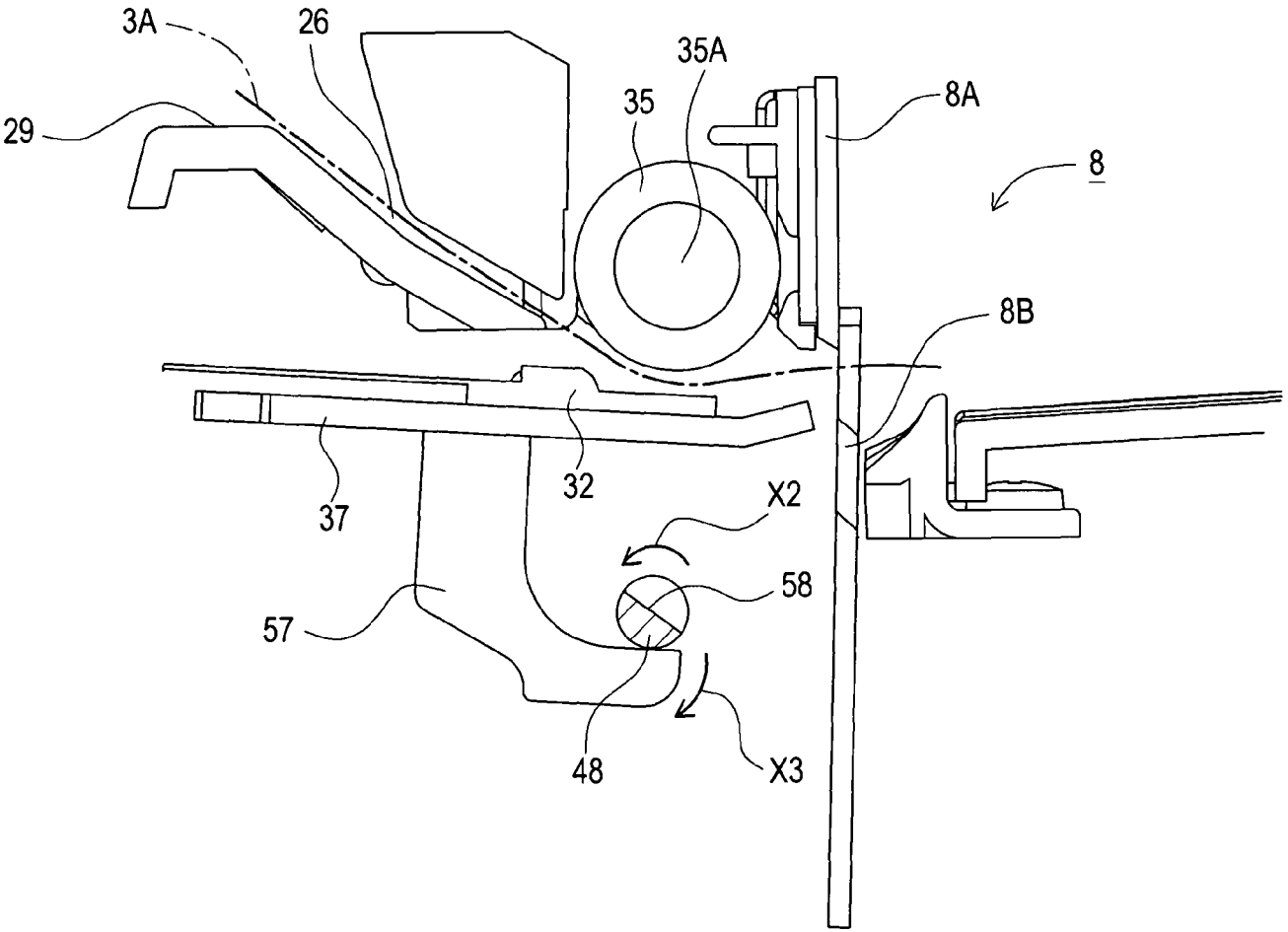
FIG. 11 is a left side view of enlarged major portions showing a state in which the thermal head has been separated from the platen roller.

If the release gear 49 is rotated about 180° counterclockwise, as seen from the left side and as shown in FIG. 11, the release shaft 48, the left end portion of which is mounted onto the release gear 49, is also rotated about 180° counterclockwise (direction of the arrow X2 in FIG. 11), as seen from the left side. The tip of the bottom interference member 57, which has a substantially L-shaped side view, and which is provided on the bottom face of the thermal head supporting member 37, is pressed downward (direction of the arrow X3 in FIG. 11) by a cylindrical face of the release shaft 48. Consequently, the head supporting member 37, resisting an urging force of the pressing spring 36, is rotated downward. The thermal head 32 is thus separated from the platen roller 35, a roll sheet 3A is inserted through the insertion port 26 and the entry of the roll sheet 3A is facilitated between the platen roller 35 and the thermal head 32.

Next, a case in which the link lever 34 slips out of the top cover 5 will be described with reference to FIG. 12-FIG. 14.

Figure 12:
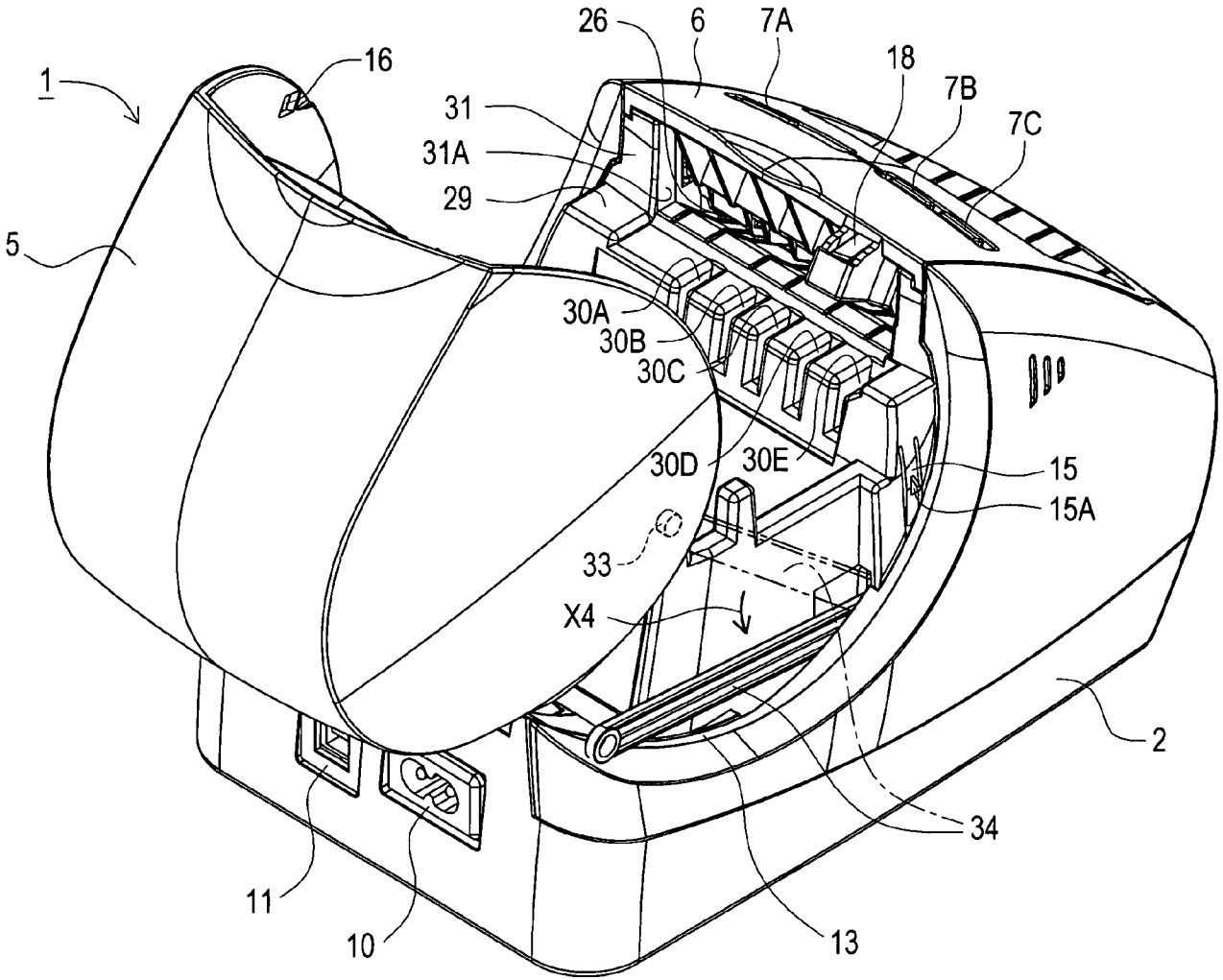
FIG. 12 is a perspective view of a state in which a link lever has been disengaged after the top cover has been opened.

When, after the top cover 5 has been opened, as shown in FIG. 12, the through hole 34A in the link lever 34 disengages from the engaging shaft 34A that has been erected inside the opening portion periphery of this top cover 5, the link lever 34 drops downward (direction of the arrow X4 in FIG. 12) and comes into contact with the step portion 13.

Figure 13:
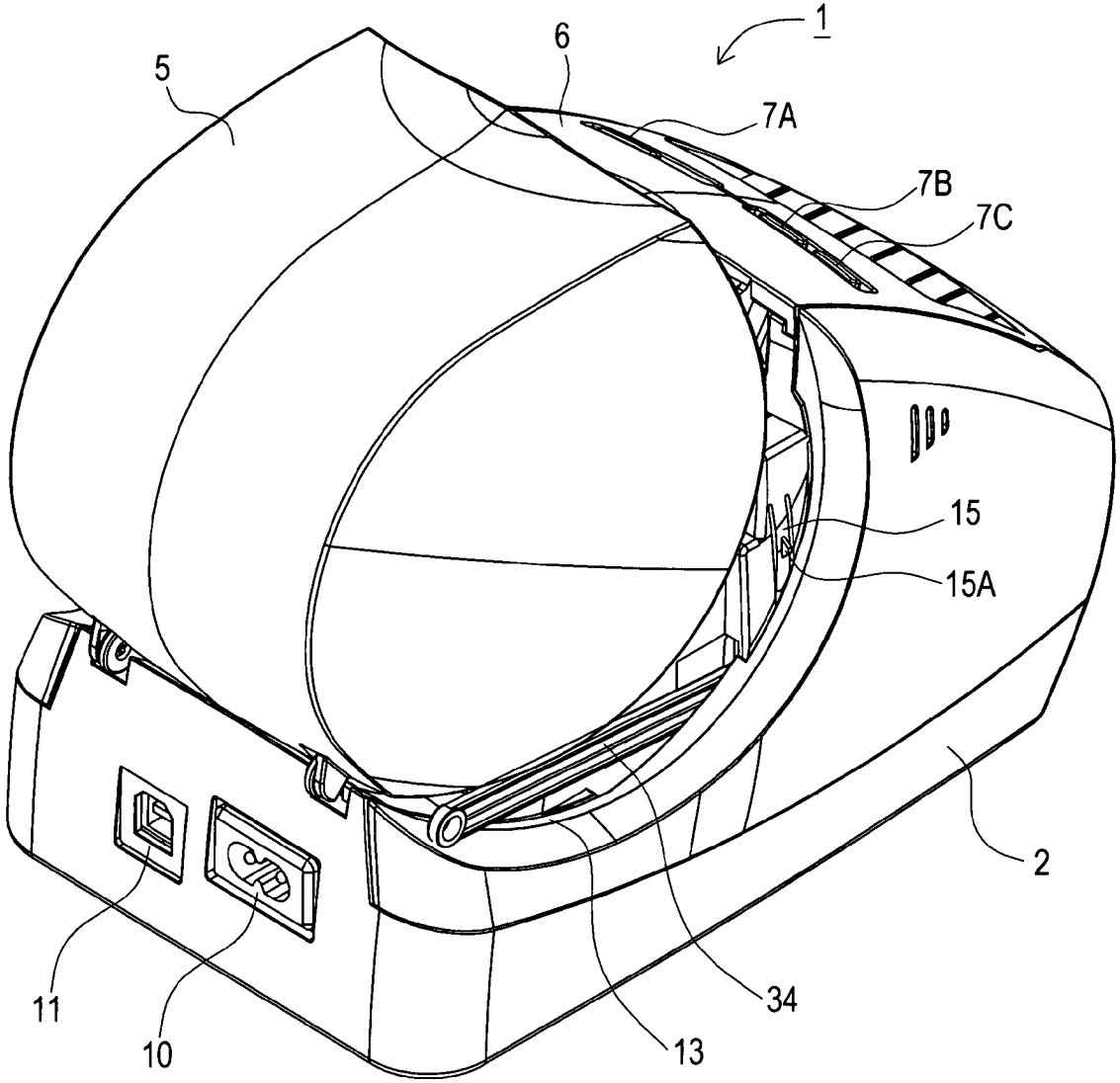
FIG. 13 is a perspective view of a state in which the top cover is about to be closed with the link lever disengaged.

Further, when, as shown in FIG. 13, the top cover 5 is about to be closed in a state shown in FIG. 12, the top cover 5 comes into contact with the link lever 34. The top cover 5 is thus prevented from being closed, because the opening portion of the top cover 5 is formed such that its width decreases as it approaches the mounting portion that is attached to the top edge on the rear side thereof (see FIG. 6). Thus, a user can see without fail that the link lever 34 is disengaged from the upper cover 5, and after the link lever 34 that has been disengaged is again installed on the top cover 5, the top cover 5 can be closed.

Figure 14:
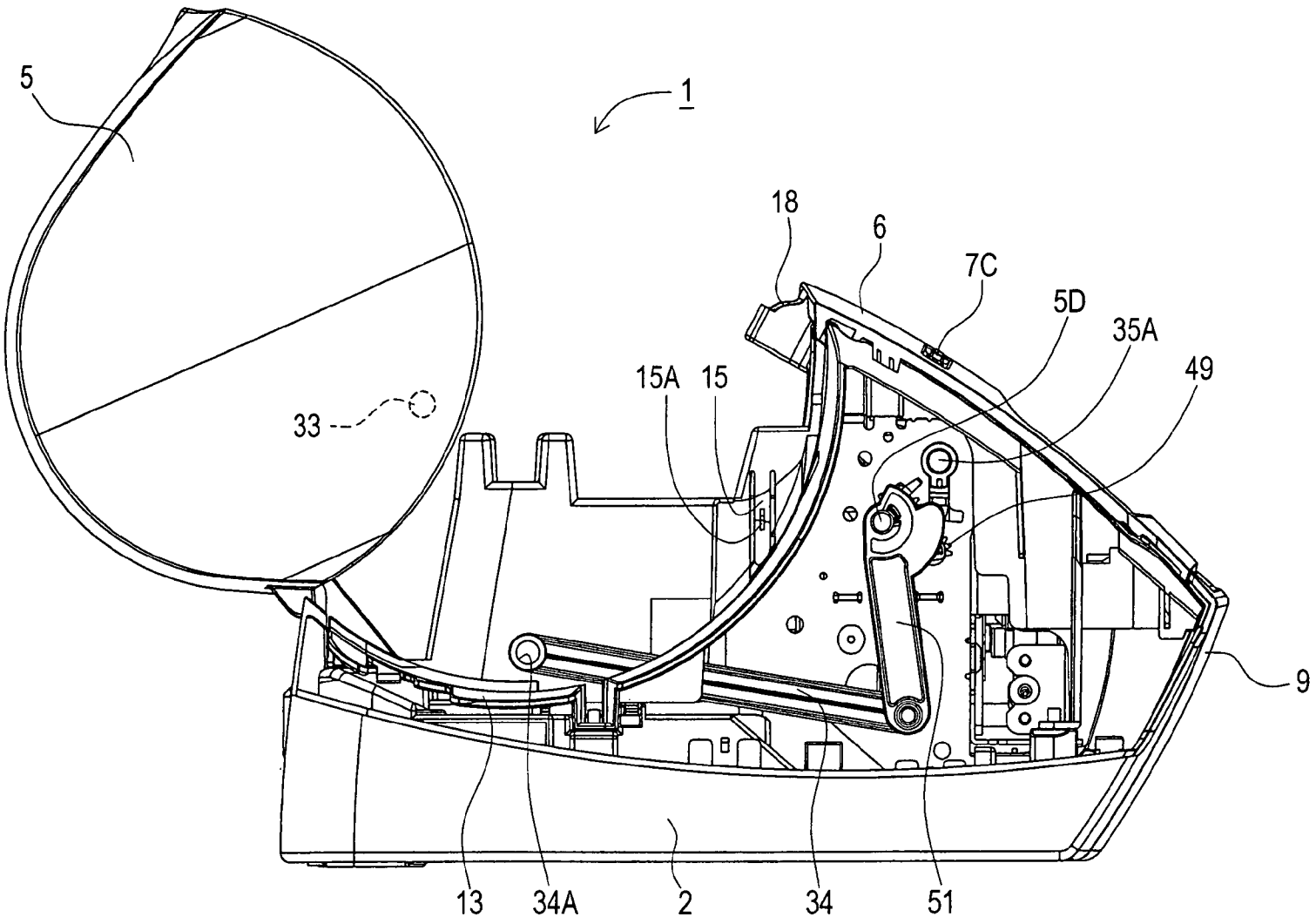
FIG. 14 is a left side view of a state in which the link lever has been pushed inward by removing the left side wall portion of the main body case, with the link lever disengaged from the top cover.

Whenever, as shown in FIG. 14, the link lever 34 has been pushed in the state shown in FIG. 12, the lever gear 52 of the release lever 51 comes into contact with the flat portion of the release gear 49, a flat portion in which no gear is formed. The link lever 34 and the release lever 51 are thus stopped in a state in which they are located substantially at right angle to each other. Thus, the link lever 34 can be prevented from being pushed into the main body case 2.

Therefore, in the tape printing apparatus 1 of this embodiment, whenever the top cover 5 has been closed, the link lever 34 is moved forward in conjunction with the motion of the top cover 5, so that the release lever 51 is rotated counterclockwise, as seen from the left side, about the lever shaft 50. Consequently, the release gear 49 and the release shaft 48 are rotated about 180° clockwise, as seen from the left side, via the lever gear 52, and the thermal head 32 presses the roll sheet 3A against the platen roller 35, thereby enabling the roll sheet 3A to be printed. In contrast, when the top cover 5 has been opened, the link lever 34 is moved backward in conjunction with the motion of the top cover 5, so that the release lever 51 is rotated clockwise, as seen from the left side, about the lever shaft 50. Accordingly, the release gear 49 and the release shaft 48 are rotated about 180° counterclockwise via the lever gear 52, the thermal head 32 is thereby separated form the platen roller 35, and a roll sheet 3A can be inserted through the insertion port 26.

In other words, in conjunction with the opening and closing of the top cover 5, contact by pressure between the platen roller 35 and the thermal head 32, and separation from each other, are achieved by means of the link lever 34, an end of which is mounted rotatably and detachably on the top cover 5. Consequently, only by means of the opening and closing of the top cover 5 which covers the top side of the roll sheet holder 3, can the roll sheet 3A be loaded, and it accordingly becomes possible to start printing rapidly by loading the roll sheet 3A simply.

The opening portion of the top cover 5 is formed such that its width decreases as it approaches the mounting portion of the main body case 2 from the attachment position of the link lever 34. Thus, even if the link lever 34 is formed into a flat shape, whenever the top cover 5 is closed after the link lever 34 has been disengaged from the top cover 5, the opening portion periphery of the top cover 5 comes into contact with the link lever 34. Disengagement of the link lever 34 is thus detected without fail and a reduction in the size of the tape printing apparatus 1 can be achieved.

The disclosure is not limited to the above-described embodiments and needless to say, may be improved or modified in various ways within a scope that does not depart from the spirit of the disclosure.

What is claimed is:

1. A tape printing apparatus including an accommodating portion which accommodates a roll sheet holder wound with a long roll sheet detachably in a main body case, a carrying unit for carrying the roll sheet, and a top cover that is mounted on a top end portion on a rear side of the main body case so as to be capable of being opened and closed freely and to cover a top side of the roll sheet holder, wherein, the carrying unit includes a carrying roller that comes into contact with the roll sheet so as to carry the roll sheet in a sheet carrying direction, and a pressing unit which includes a thermal head, wherein said pressing unit presses the roll sheet against an outer peripheral face of the carrying roller, the tape printing apparatus further comprising:

a link lever which is shaped like a long plate, and an end portion of one side of which is mounted onto an opening portion periphery of the top cover rotatably and detachably; and a release unit, which includes a release lever that is rotatably mounted on one side to the apparatus and is rotatably coupled on an end portion of another side thereof to another side of the link lever; and when said release lever is rotated about said one side, said release unit achieves contact by pressure between the carrying roller and the pressing unit by advancing the thermal head towards the carrying roller, and alternatively achieves separation between the carrying roller and the pressing unit, in conjunction with closing and alternatively opening of the top cover by means of the link lever.

2. The tape printing apparatus according to claim 1, wherein, when an end portion on one side of the link lever slips out of the top cover, the top cover interferes with the link lever so as to prevent the top cover from being closed at a position at which the top cover covers the roll sheet holder.

3. The tape printing apparatus according to claim 2, wherein the link lever is mounted inside the periphery of the opening portion of the top cover, and the opening portion of the top cover is formed such that a width thereof decreases as it moves from a mounting position of the link lever toward a mounting portion of the main body case, so that if the end portion on the one side of the link lever slips out of the top cover, when the top cover has been closed, the periphery of the opening portion of the top cover comes into contact with the link lever.

4. The tape printing apparatus according to claim 3, wherein the carrying roller is a platen roller, and the thermal head is pressed against the outer peripheral face of the platen roller, so that contact by pressure between the platen roller and the thermal head, and their separation from each other, are achieved by means of the release unit.

5. The tape printing apparatus according to claim 2, wherein the carrying roller is a platen roller, and the thermal head is pressed against the outer peripheral face of the platen roller, so that contact by pressure between the platen roller and the thermal head, and their separation from each other, are achieved by means of the release unit.

6. The tape printing apparatus according to claim 1, wherein the carrying roller is a platen roller, and the thermal head is pressed against the outer peripheral face of the platen roller so as to achieve contact by pressure between the platen roller and the thermal head, and their separation from each other, by means of the release unit.

* * * * *